US005937225A

United States Patent [19]

Samuels

[11] Patent Number: 5,937,225

[45] Date of Patent: Aug. 10, 1999

[54] PIXEL COUNTING TONER OR INK USE MONITOR AND PIXEL COUNTING METHOD FOR MONITORING THE TONER OR INK USE

[75] Inventor: Donald J. Samuels, Yorktown, N.Y.

[73] Assignee: International Business Machines Corporation, Armonk, N.Y.

[21] Appl. No.: 08/897,963

[22] Filed: Jul. 21, 1997

[51] Int. Cl.[6] ..... G03G 15/08

[52] U.S. Cl. ..... 399/27; 347/7; 399/61; 399/143

[58] Field of Search ..... 399/27, 255, 258, 399/262, 143, 61; 347/7; 358/296

[56] References Cited

U.S. PATENT DOCUMENTS

| | | | |
|---|---|---|---|
| 3,409,901 | 11/1968 | Dost et al. | 346/74 |
| 3,529,546 | 9/1970 | Kollar | 101/426 |
| 4,413,264 | 11/1983 | Cruz-Uribe et al. | 346/1.1 |
| 4,468,112 | 8/1984 | Suzuki et al. | 355/14 D |
| 4,961,088 | 10/1990 | Gilliland et al. | 399/25 |
| 5,068,806 | 11/1991 | Gatten | 347/7 |
| 5,204,698 | 4/1993 | LeSueur et al. | 346/160 |
| 5,204,699 | 4/1993 | Birnbaum et al. | 246/160 |
| 5,349,377 | 9/1994 | Gilliland et al. | 346/153.1 |
| 5,585,899 | 12/1996 | Palumbo et al. | 399/258 |
| 5,636,032 | 6/1997 | Springett | 358/296 |
| 5,706,037 | 1/1998 | McIntyre | 347/3 |

FOREIGN PATENT DOCUMENTS 4-109274 4/1992 Japan .

*Primary Examiner*—Arthur T. Grimley
*Assistant Examiner*—Quana Grainger
*Attorney, Agent, or Firm*—Daryl K. Neff

[57] ABSTRACT

A printer specific stream of bits is received, before or while the printing of a print job, and translated into a pixel count specific to the print job and indicative of the anticipated toner usage for the print job. This pixel count then is added to a global pixel count indicative of toner usage of jobs printed since a global pixel counter was reset.

13 Claims, 1 Drawing Sheet

PIXEL COUNTING TONER OR INK USE MONITOR AND PIXEL COUNTING METHOD FOR MONITORING THE TONER OR INK USE

The present invention relates to the monitoring and estimating of toner used in a printer, such as laser printer and ink jet printer.

BACKGROUND OF THE INVENTION

Laser printers and ink jet printers have a toner or ink cartridge. Usually, sensors are employed to detected when a cartridge is empty. In this case, either an indicator on the printer notifies the user that the cartridge is empty, or a respective message is sent back to the computer or network to which the printer is connected.

Various approaches are known which provide for a precise determination of the amount of toner to be used in a xerographic system, for example. According to U.S. Pat. No. 3,409,901, M. H. Dost et al., filed Jul. 13, 1967, for instance, the beam current for a cathode ray tube used in a xerographic system is integrated to estimate the toner concentration needed in the system.

In U.S. Pat. No. 4,468,112, Suzuki et al., filed Feb. 11, 1982, constant optimum image density is achieved in an electrographic copier by employing appropriate detectors which determine the image density and based on that the amount of toner to be fed to the developer.

Methods for continuously monitoring toner depletion from a development station is described in U.S. Pat. No. 3,529,546, Kollar which issued September 1967, and U.S. Pat. No. 4,413,264, A. S. Cruz-Uribe et al., filed Jan. 11, 1982. The replenishing rate is adjusted in response to the number of character print signals (e.g. pixel signals) applied to the print head.

Another approach for the determination of toner depletion from the developer mixture is addressed in U.S. Pat. No. 5,204,698, LeSueur et al., filed Aug. 27, 1992.

There is a need for remotely detecting and monitoring the toner or ink usage on-the-fly in a flexible and cost-effective manner. This would help to better manage resources and to make decision before or while a print job is executed.

It is an object of the invention to provide an apparatus or method which keeps track of the amount of toner or ink used in a printer since the toner or ink has been refilled or the cartridge has been replaced.

It is another object to provide immediate feedback to the user or operator as to how much toner or ink will be required for a particular print job.

It is a further object to provide for an indication if the toner or ink cartridge is expected to be empty.

It also is an object to determine the cost of a particular print job taking into consideration not only the number of pages, but also the amount toner or ink required.

SUMMARY OF THE INVENTION

The above objectives have been accomplished by the provision of a method and apparatus which receive a printer specific stream of bits before or while the printing of a print job. This stream of bits is translated into a pixel count specific to the print job and indicative of the anticipated toner usage for the print job. This pixel count then is added to a global pixel count indicative of toner usage of jobs printed since a global pixel counter was reset.

The accuracy of the pixel count can be improved by adding to the global pixel count only if a print job was actually executed, by using a weighing factor which helps to take into consideration the image density, the frequency of pixel changes and other parameters which have an influence on the actual amount of toner or ink used.

The advantages of this approach become apparent from the below detailed description.

BRIEF DESCRIPTION OF THE DRAWINGS

The foregoing and other teachings of the present invention will become more apparent upon a detailed description of detailed implementations of the invention as rendered below. In the description to follow, reference will me made to the accompanying drawings, in which.

DETAILED DESCRIPTION OF A PREFERRED EMBODIMENT OF THE INVENTION

The present invention can be used in toner-based printers, such a laser printers, as well as ink-based printers, such as ink jet printers. The detailed description's focus, however, is on laser printers.

In the following, the image process used in many laser printers is described in very general terms in order to define the environment in which the invention may be used. It is to be understood that the present invention also can be used in ink jet printers.

Figure 1:
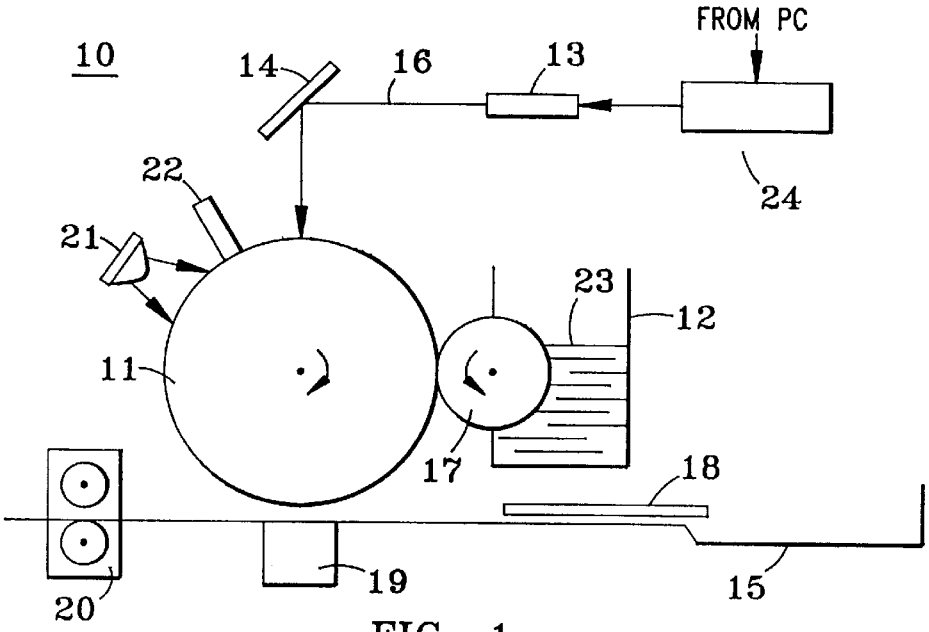
FIG. 1 PRIOR ART
FIG. 1 is a schematic view of a laser printer as known in the art.

The basic elements of a laser printer 10 are illustrated in FIG. 1. The printer 10 comprises a drum 11, a toner cartridge 12, waste hoppers (not shown), a laser or laser array 13 emitting a laser beam 16, an mirror 14, a paper tray 15, a developer roller 17, a corona 19, and a fuser 20.

The first thing that happens is that the computer (not shown in FIG. 1), or the application program accessing the printer, sends a stream of bits through an interface 24 to the laser printer 10. This stream of bits either is formatted already for the specific printer used, or it will be formatted by the printer. Usually, a printer 10 has a storage where the stream of bits is stored (not explicitly illustrated). Once enough bits have arrived to complete a page, the laser printer 10 starts a series of things. First, it starts to send the bit stream representing a page from the interface 24 line by line to the laser 13. A laser beam 16 is modulated to place dots on the rotating drum 11, one line at a time. The laser beam 16 hits a mirror 14 that directs it to the drum's surface. The laser beam 16 causes the drum 11 to become negative (or positive, depending on the particular system) in the places the beam 16 hits. As the drum 11 rotates, it touches a roller 17 called the developer roller or the Mag rollers.

The purpose of the roller 17 is to pick up toner 23 from the toner cartridge 12, then with an even layer of it, roll on to the drum 11. The roller 17 is charged with positive (or negative) voltage. Again, this depends on the printer. When the drum 11, with a lack of voltage meets the toner with the excess voltage, the toner is pulled into the places the laser beam 16 has touched. The next step is to move the toner from the drum 11 to the paper 18. In FIG. 1, there is an item called a Corona 19. This is a thin wire that sits under the drum 11 and is charged with a very high voltage. As the drum 11 turns, the paper 18 passes over the corona 19 such that it is situated between the corona 19 and the drum 11.

The paper 18 is touching the drum 11 a slight bit. The high voltage running through the corona's wire creates a pull to attract the toner from the drum 11 onto the paper 18. As the paper 18 moves on, it takes this image to the next section of the printer referred to as the fuser area.

Before we address the fuser 20, the description of the drum's function is continued. Usually, the drum 11 is illuminated by a special lamp 21 that erases or returns the drum 11 back to its state of discharge. The image is removed with a blade 22 near the erase lamp 21 and as a result the drum 11 is now clean. As it continues to rotate, it is charged up for the next image with a second corona wire (not shown). In some printers charge rollers are employed. In any case, the drum 11 is recharged to positive (or negative) forces and the image process starts all over.

The final step before a printout is ready, is to fuse the toner 23 to the paper 18. As the paper 18 with the toner image is moving out of the image area, it moves into the fuser section. The fuser 20 is a device that has two rollers which touch the paper 18 with a great deal of force between them. One of the rollers is heated to up to 200 degrees or more. The two pressure rollers heat up and fuse the toner to the fibers on the paper 18. The fuser 20 then pushes the paper 18 out of the printer 10.

First Implementation

Figure 2:
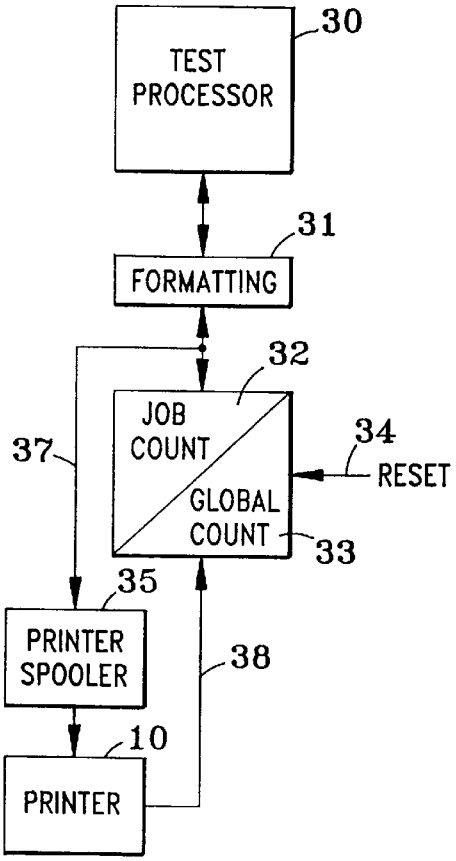
FIG. 2 is a schematic block diagram of a system according to the present invention.

A first implementation of the present invention is schematically illustrated in FIG. 2. As shown in this Figure, an application program 30 (e.g. a text processing software) sends a finished document to a formatting entity 31. Usually, the formatting entity 31 is a program which intercepts a print job and formats it. The formatting is done based on a selection of parameters. During formatting, the font size may be reduced and the page may be rotated to suit the particular printer selected for printing, just to give some examples. The formatting entity 31 generates a printer specific stream of bits which in a conventional system is sent via link 37 to the printer spooler 35.

According to the present invention, said printer specific stream of bits is also fed to an entity 32 which translates the stream of bits into a pixel count. This pixel count is indicative of the anticipated toner usage when actually printing the print job on the printer 10. The pixel count can be determined by means of a simple algorithm, or by a table look up. In order to ensure precise prediction of toner usage, a weighing factor might be taken into consideration to take care of printer or job specific considerations. The pixel count is proportional to the number of pixels to be toned. One may factor in a signal which is representative and proportional of the contrast, as described in U.S. Pat. No. 5,204,699.

The weighing factor may likewise be determined by monitoring the frequency, as well as the number of black image bits in the printer specific stream of bits and by assigning a weight to the monitored frequency range, as described in U.S. Pat. No. 5,349,377, for example.

This pixel count generated by the entity 32 is then forwarded to a global pixel count entity 33 where it is added to a global pixel count. This global pixel count is indicative of the toner usage since the printer's toner cartridge has been replace or refilled. When refilling or replacing the toner cartridge, the global pixel count has to be reset via reset input 34. This can be done automatically upon receipt of an appropriate signal from the printer, or manually after the user replaced the toner.

The entity 32/33 further comprises comparator means to compare the global pixel count with a global threshold. This global threshold depends on the toner cartridge used. The size of a toner cartridge is printer specific and so is the global threshold. The global threshold can either be derived from information provided by the printer driver, if a specific printer driver is used, or it can be defined by the user when installing the printer or when replacing the toner.

The comparator watches the global pixel count and compares it with the global threshold. If the global pixel count approaches the global threshold, a signal may be generated which provides for the notification of the user or operator, for example. This signal may be used to trigger the generation of a message displayed to the user of the text processing software 30.

Upon receipt of the message that the toner is soon expected to be empty, the user or operator may decide to replace or refill the toner.

In addition, another comparator may be provided which compares the pixel count for a print job with a job threshold. This allows to display a message if the pixel count for a particular print job exceeds a predefined job threshold. Furthermore, the pixel count may be compared to another threshold to cause the inversion of the job to be printed. If a user tries to print a screen copy of a black screen with font, for example, this obviously would consume a lot of toner. The present invention enables the user to define a threshold such that these kind of jobs are inverted such that now a black font is used on white background. The user may be prompted before the print job actually is inverted, or is given an opportunity to cancel if the print job was actually a mistake.

As indicated in FIG. 2, a feedback loop 38 may be employed. By means of this feedback loop 38 the inventive entity 32/33 is notified if a print job has actually been completed. The global pixel count entity 33 may be designed such that a job specific pixel count is added to the global pixel count only if a confirmation is received that the job has been printed.

Notification may also be provided after completion of each page. This allows to take situations into account where a jam occurred and the print job is restarted in the middle instead of the beginning. In such a case the count must take this into account.

If no such feedback loop is employed the global pixel count will be less precise because the global pixel count will be increased even if the job has not been printed (e.g. because the printer was jammed) and no toner has been used for this particular job or partial job. This is not a problem as long as it is ensured that the global pixel count always reflects a pessimistic prediction of toner usage. This will lead to situations where a message is displayed that the toner is deemed to be empty even if some toner is still left in the cartridge.

It is obvious that the above implementation can be modified by resetting the global pixel count to the global threshold and decreasing it (instead of increasing it as provided for in the above example) each time a job is printed. If the global pixel count reaches zero, the toner is assumed to be empty or almost empty.

Second Implementation

Figure 3:
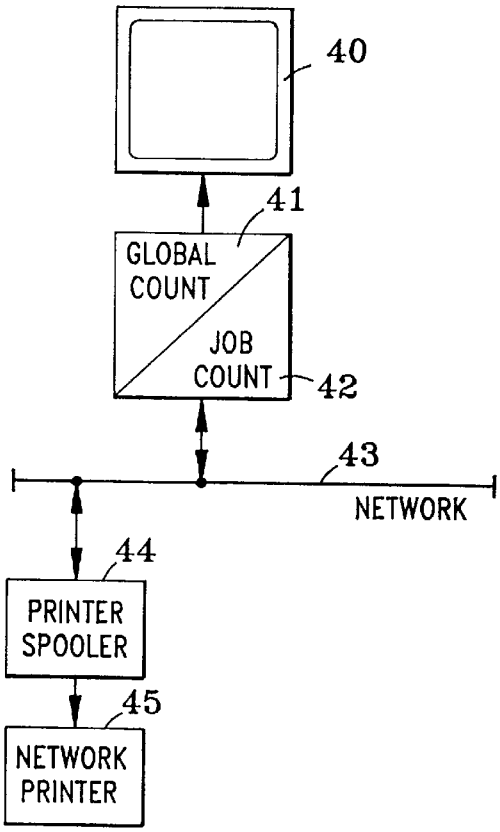
FIG. 3 is a schematic block diagram of another system according to the present invention.

The present invention is well suited for use in a network based environment. It allows the network operator to monitor the toner usage of printer connected to the network. A typical implementation is illustrated in FIG. 3.

In a network system, usually several computers, terminals and workstation share a printer 45. These computers, terminals and workstation (not shown in FIG. 3) are connected to and interconnected by the network 43. Print jobs created by a local application program, for example, is issued onto the network 43 and transmitted to the printer spooler 44. This printer spooler then sends the print job to the network printer 45. Several print jobs from different sources can be handled by such a configuration. As shown in FIG. 3, the present invention is well suited for use in such an environment. The job count entity 42 can be connected to the network 43 such that a pixel count is created for each stream of bits sent to the printer spooler 44. As described in connection with the first implementation, this pixel count is added to a global pixel count which allows the operator to keep track of the toner usage since the toner has been refilled or replaced. A display 40 may be connected to the entity 41/42 such that the operator can view the status of the global pixel count, for example. The entity 41/42 may likewise report to a network management station by issuing SNMP (simple network management protocol) messages, for example. The pixel counting and global pixel counting can also be implemented within a network printer server.

The entity 41/42 can watch the traffic on the network to get information as to whether pages of a particular print job or the whole print job has been executed successfully or not. The global pixel count may be increased by a particular pixel count each time one page of a print job has been completed, or only if the respective print job as a whole has been reported to be executed.

Third Implementation

The present invention is suited for use in a network based environment, as already described in connection with the second implementation.

As will be described in the following, use of the invention is not limited to smaller networks, such as local area networks (LANs) for example. The invention can also be used in wide area networks (WANs), the Internet, or the world-wide-web (WWW).

Since in such an environment the communication is not a simple communication between a printer server and a job count entity which both are connected to one and the same LAN, for example, but between a printer server and a job count entity in another, possibly completely different domain, or network, additional problems have to be taken care off.

The kind of problems inherent to a WAN, Internet, or WWW implementation of the present invention become obvious from the following example.

The printer server to be monitored may be connected to an Ethernet LAN in a site in a first country whereas the job count entity is part of a network management station connected to a Token Ring network in another country.

There are two different ways of how to implement the job count entity in such an environment. The first is referred to as concentrated implementation and the second is referred to a distributed implementation.

In case of a concentrated implementation, the job count entity sits at one location, e.g. within a network management station. In this case, each stream of bits sent to the printer spooler has also to be sent to the job count entity. Based on the stream of bits, the job count entity then calculates the amount of toner expected to be used. Additionally, the job count entity should get feedback if a whole print job and/or a page of that print job has been completed by the printer. Such a feedback is more important than in case of the first two implementations, since in the third implementation there may be a huge distance between the network management station monitoring the toner usage and the printer. There is no way of manually controlling whether paper is jammed and the like. In case of the so-called distributed implementation of the present invention, the job count entity comprises two units. The first unit is located at the printer server or spooler. It may either be an integral part thereof, or it may be connected to it through a network. This first unit receives the bit stream sent to the printer. Based on this bit stream it generates a job specific pixel count.

The second unit of the job count entity usually is located at the network management station. This second unit maintains a global pixel count for each printer (or color). The first unit either sends unsolicited update messages to the second unit, or the second unit pulls the respective information from the first unit.

The first unit may further comprise means to make the job specific pixel count only available to the second unit if the print job or a part thereof has been completed.

Well suited for communication between the first and second unit is the user datagram protocol, which is a TCP/IP protocol. The units of the job count entity have to be able to exchange UPD messages.

The simple network management protocol (SNMP) can also be used for communication purposes. SNMP provides means for unsolicited exchange of information (referred to as traps) as well as means for requesting (get) information. The advantage of an SNMP/UDP implementation is that it can be used on top of almost any kind of network, such as frame relay, ethernet, token ring and so forth.

The third implementation allows to integrate a toner usage monitor, according to the present invention, into a network management software, for example. Such a network management software, if installed on a network management station, allows the operator to monitor the actual usage of toner as well as to obtain information as to when a toner cartridge is expected to be empty. In such a case, a service engineer may be called up to replace the toner, or the service department may be notified. In a more sophisticated implementation, the network operator may also redistribute print jobs to ensure that only printers with sufficient toner are used for certain jobs.

The job count entity may also be implemented as part of a WWW-browser, for example. This browser either allows the user to log on to the remote job count entity to find out (pull) whether the toner is soon going to be empty, or the job count entity may notify (push) the browser in case that the toner is expected to be empty.

Besides the fact that the present invention allows the monitoring of the toner usage in printers, it can also be used to provide the user with information as to what a particular print job will cost when executed. A table look up allows to provide the user with an estimate. This estimate not only takes into consideration the number of pages used, but also the amount of toner used.

The present invention can also be used in color printers. In such an environment, a counter per color has to be provided. If the anticipated toner usage indicates that the color blue, for example, is almost empty, the user may be prompted to change the color library accordingly, or to replace the toner.

What is claimed is:

1. Method for determining toner usage in a printer, comprising the steps of:

receiving a printer specific stream of bits before or while printing a print job, translating the stream of bits into a pixel count specific to the print job and indicative of toner usage for the print job, displaying a message which proposes to invert or cancel the print job if the anticipated toner usage is above a threshold, and adding said pixel count to a global pixel count indicative of toner usage of jobs printed since a global pixel counter was reset.

2. Method for determining toner usage of a printer connected to a network, comprising the steps of:

translating a stream of bits, before or while printing a print job, into a pixel count specific to the print job and indicative of toner usage for the print job, displaying a message which proposes to invert or cancel the print job if the anticipated toner usage is above a threshold, and adding said pixel count to a global pixel count indicative of toner usage of jobs printed since a global pixel counter was reset.

3. The method of claim 2, wherein said global pixel counter is reset if a new toner cartridge is put into the printer.

4. The method of claim 2, wherein a message is displayed if the global pixel count exceeds a threshold indicating that the toner cartridge is soon expected to be empty.

5. The method of claim 2, wherein the printer specific stream of bits is created by an application program taking into consideration default or user-defined settings for the printing of the print job.

6. The method of claim 2, wherein the pixel count specific to the print job is added to said global pixel count only after a notification has been received from the printer that the print job has been executed.

7. The method of claim 2, wherein a message is displayed which indicates the anticipated toner usage for the print job.

8. The method of claim 2, wherein the print job is executed only if the anticipated toner usage is below a job threshold.

9. The method of claim 2, wherein the print job is executed only if the user or operator confirms that the print job is to be executed.

10. Apparatus for determining toner usage of a printer, comprising:

means for receiving a printer specific stream of bits, pixel counter for translating the stream of bits into a pixel count specific to the print job and indicative of toner usage for the print job, means for inverting a print job if the anticipated toner usage exceeds a predefined threshold, and a global pixel counter for adding said pixel count provided by said pixel counter to a global pixel count indicative of toner usage of jobs printed since the global pixel counter was reset.

11. The apparatus of claim 10, wherein the print job comparator provides notification to the user or operator if the anticipated toner usage for a print job is above the job threshold.

12. The apparatus of claim 10, wherein the print job is executed only if the anticipated toner usage for a print job is below the job threshold.

13. The apparatus of claim 10, wherein the print job is executed only if the user or operator confirms that the print job is to be executed.

* * * * *